US009642769B2

(12) United States Patent
Ma et al.

(10) Patent No.: US 9,642,769 B2
(45) Date of Patent: May 9, 2017

(54) HEAD MASSAGER

(71) Applicant: Shenzhen Breo Technology Co., Ltd., Shenzhen, Guangdong (CN)

(72) Inventors: Xuejun Ma, Guangdong (CN); Rui Li, Guangdong (CN)

(73) Assignee: SHENZHEN BREO TECHNOLOGY CO., LTD., Shenzhen (CN)

( * ) Notice: Subject to any disclaimer, the term of this patent is extended or adjusted under 35 U.S.C. 154(b) by 687 days.

(21) Appl. No.: 14/148,692

(22) Filed: Jan. 6, 2014

(65) Prior Publication Data

US 2014/0121577 A1 May 1, 2014

Related U.S. Application Data

(63) Continuation of application No. PCT/CN2012/083937, filed on Nov. 1, 2012.

(30) Foreign Application Priority Data

Jun. 20, 2012 (CN) ..... 2012 1 0205261

(51) Int. Cl.
*A61H 15/00* (2006.01)
*A61H 7/00* (2006.01)

(52) U.S. Cl.
CPC ..... *A61H 15/0078* (2013.01); *A61H 7/005* (2013.01); *A61H 7/007* (2013.01);
(Continued)

(58) Field of Classification Search
CPC .... A61H 15/0078; A61H 7/005; A61H 7/007; A61H 2201/1454; A61H 2201/1692; A61H 2205/021; A61H 2201/1215; A61H 2201/1673; A63B 22/14; A63B 22/16; A63B 22/18
See application file for complete search history.

(56) References Cited

U.S. PATENT DOCUMENTS 1,577,751 A * 3/1926 Paschall ..... A61H 7/004 15/22.1
1,931,849 A * 10/1933 Matson ..... A61H 7/005 601/112

(Continued)

FOREIGN PATENT DOCUMENTS

CN 2155105 9/1992
CN 201230957 5/2009

(Continued)

*Primary Examiner* — Justine Yu
*Assistant Examiner* — Christopher Miller
(74) *Attorney, Agent, or Firm* — Westerman, Hattori, Daniels & Adrian, LLP

(57) ABSTRACT

A head massager including a housing, a power source, at least one driving wheel, at least one massage head assembly and at least one push component. The power source is fixed in an inner side of the housing, the at least one driving wheel is driven to rotate around a first rotation axis by the power source, and the at least one massage head assembly is located below the at least one driving wheel. The massage head assembly is driven to rotate around the center of the spherical hinge by the at least one push component arranged aslant, which simulates human hands' grasping and kneading operation and improves the massaging comfort degree.

7 Claims, 5 Drawing Sheets

(52) U.S. Cl.
CPC ..... *A61H 2201/1215* (2013.01); *A61H 2201/1418* (2013.01); *A61H 2201/1454* (2013.01); *A61H 2201/1673* (2013.01); *A61H 2201/1692* (2013.01); *A61H 2205/021* (2013.01)

(56) References Cited

U.S. PATENT DOCUMENTS 2,038,846 A * 4/1936 Matson ..... A61H 7/004 601/133
2,232,493 A * 2/1941 Stuckey ..... A45D 19/00 15/22.1
3,993,052 A * 11/1976 Miyahara ..... A61H 7/005 601/87
4,290,601 A * 9/1981 Mittelstadt ..... A63B 22/18 472/14
4,550,718 A * 11/1985 Kaeser ..... A61H 15/0092 15/144.2
4,730,605 A * 3/1988 Noble ..... A61H 23/0263 601/110
4,920,957 A * 5/1990 Sutherland ..... A61H 7/005 601/101
5,065,743 A * 11/1991 Sutherland ..... A61H 7/005 601/101
5,485,862 A * 1/1996 Kahn ..... A61H 3/068 135/77
5,628,123 A * 5/1997 Chan ..... A45D 20/12 34/90
5,803,916 A * 9/1998 Kuznets ..... A61H 7/004 601/101
2006/0047234 A1* 3/2006 Glucksman ..... A45D 26/0004 601/87
2007/0276301 A1* 11/2007 Schefthaler ..... A61H 23/0263 601/86
2007/0299376 A1* 12/2007 Schefthaler ..... 601/89
2010/0179460 A1* 7/2010 Tsai ..... A61H 7/004 601/134
2014/0088522 A1* 3/2014 Nuzzo ..... A61H 7/005 604/290

FOREIGN PATENT DOCUMENTS

CN 201316384 9/2009
DE 19616759 12/1996

* cited by examiner

HEAD MASSAGER

BACKGROUND OF THE INVENTION

1. Technical Field

The present invention relates to a health massager device, and more particularly, to a health head massager.

2. Description of Related Art

In the prior art, a head massager includes a housing, a power source, drive mechanisms and soft massage heads. The power source is fixed in an inner side of the housing, the drive mechanisms are driven to rotate by the power source by means of gear sets, and then the soft massage heads are driven to horizontally rotate by the drive mechanisms. However, the massaging comfort degree of the head massager in the prior art is bad.

BRIEF SUMMARY OF THE INVENTION

The present invention provides a head massager with comfortable massage effect.

A head massager provided in the present invention includes a housing, a power source, at least one driving wheel, at least one massage head assembly with soft massage heads and at least one push component, the power source is fixed in an inner of the housing, the driving wheel corresponds to the massage head assembly respectively, the driving wheel is driven to rotate around a first rotation axis by the power source, the massage head assembly is located below the driving wheel corresponding to the massage head assembly, the push component corresponds to the massage head assembly respectively, the push component is tilted relative to the first rotation axis, the massage head assembly and the housing are connected by means of a spherical hinge, the push component is driven to rotate around the first rotation axis by the driving wheel corresponding to the push component, the massage head assembly is driven to rotate around a center of the spherical hinge by the push component.

A rotating trail of the push component forms a cone or a conical surface.

Furthermore, the push component is a slope tilted relative to the first rotation axis, the driving wheel includes a lower end face facing the massage head assembly, the massage head assembly comprises an upper end face facing the driving wheel, the upper end face is a slope tilted relative to the first rotation axis, the push component is the lower end face, the massage head assembly is driven to rotate around the center of the spherical hinge by means of the upper end face applied force by the lower end face.

Furthermore, the upper end face is contacted with the lower end face.

Furthermore, a plurality of balls are provided between the upper end face and the lower end face. The balls are arranged on a ball fixing seat. The ball fixing seat and the driving wheel are fixed. If diameters of the balls are the same, the upper end face is in parallel with the lower end face; if the diameters of the balls are different from each other, the upper end face isn't in parallel with the lower end face. Tops of all the balls are tangent to the lower end face; bottoms of all the balls are tangent to the upper end face.

Furthermore, the driving wheel comprises a lower end face facing the massage head assembly, the massage head assembly comprises an upper end face facing the driving wheel, a plurality of balls are provided between the upper end face and the lower end face, diameters of all the balls are different from each other, the balls are the push component, the upper end face is a slope tilted relative to the first rotation axis, tops of all the balls are tangent to the lower end face, bottoms of all the balls are tangent to the upper end face.

Furthermore, the push component is independent from the driving wheel, the push component comprises a force bearing end located at the top and a force applying end located at the bottom, the driving wheel defines an eccentric hole eccentrically arranged with the first rotation axis, the force bearing end is engaged in the eccentric hole, and the force applying end is used to drive the massage heads.

Furthermore, the center is located outside the axis of the eccentric hole.

Furthermore, the massage head assembly includes a spherical head, the housing comprises a spherical bowl, the spherical head engages with the spherical bowl, so that the massage head assembly and the housing are connected by means of the spherical hinge, the spherical head is restricted in a bottom of the spherical bowl by a fixing component.

Furthermore, the bottom of the spherical bowl is provided with a through groove penetrating the spherical bowl up and down, the massage head assembly comprises an extending post protruded upwards, the extending post passes through the through groove and arrives in an inner of the spherical bowl, the extending post and the spherical head are fixed, the extending post is the fixing component.

Furthermore, the housing includes a main body, both of a top and a bottom of the main body are open, a top opening is closed by a top cover, a bottom opening is provided with a base, the driving wheel is mounted on the base, the driving wheel is driven to rotate around the first rotation axis relative to the base, and the spherical bowl is provided on the base.

The present invention has the following benefits: The massage head assembly is driven to rotate around the center of the spherical hinge by the push component arranged aslant, which simulates human hands' grasping and kneading operation and improves the massaging comfort degree.

DETAILED DESCRIPTION OF THE INVENTION

The present invention will be explained below in detail with reference to the accompanying drawings and embodiments.

Figure 1:
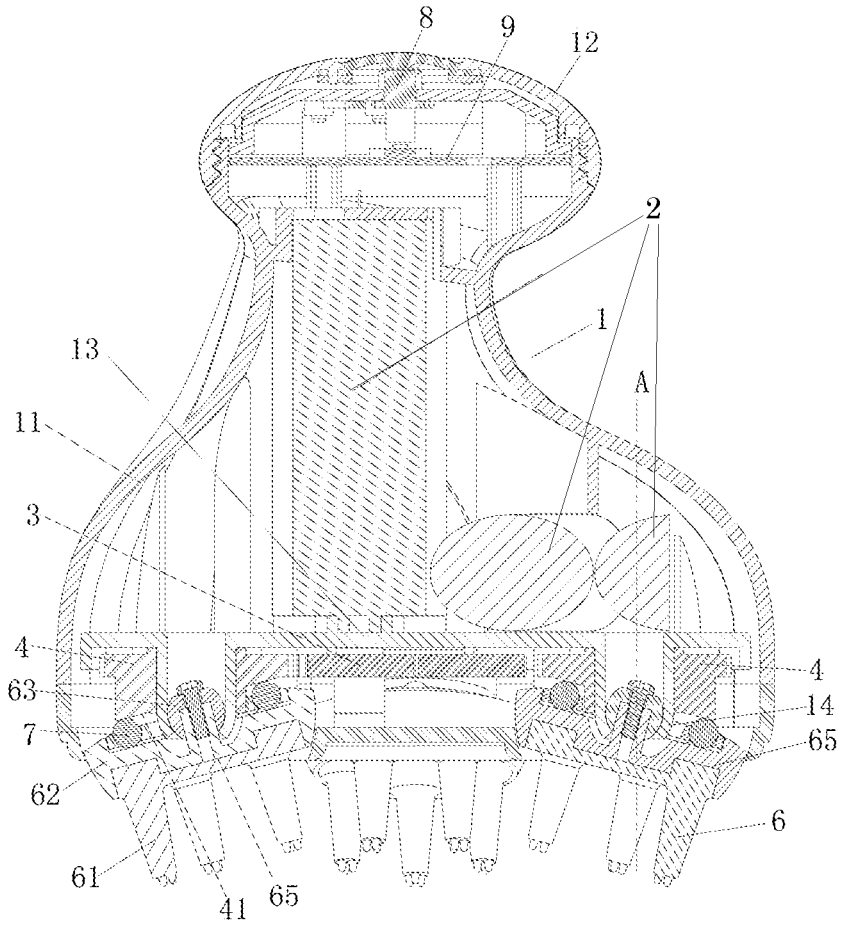
FIG. 1 and FIG. 2 are schematic structure views of a head massager of a first embodiment of the present invention in two different angles of view respectively.
Figure 2:
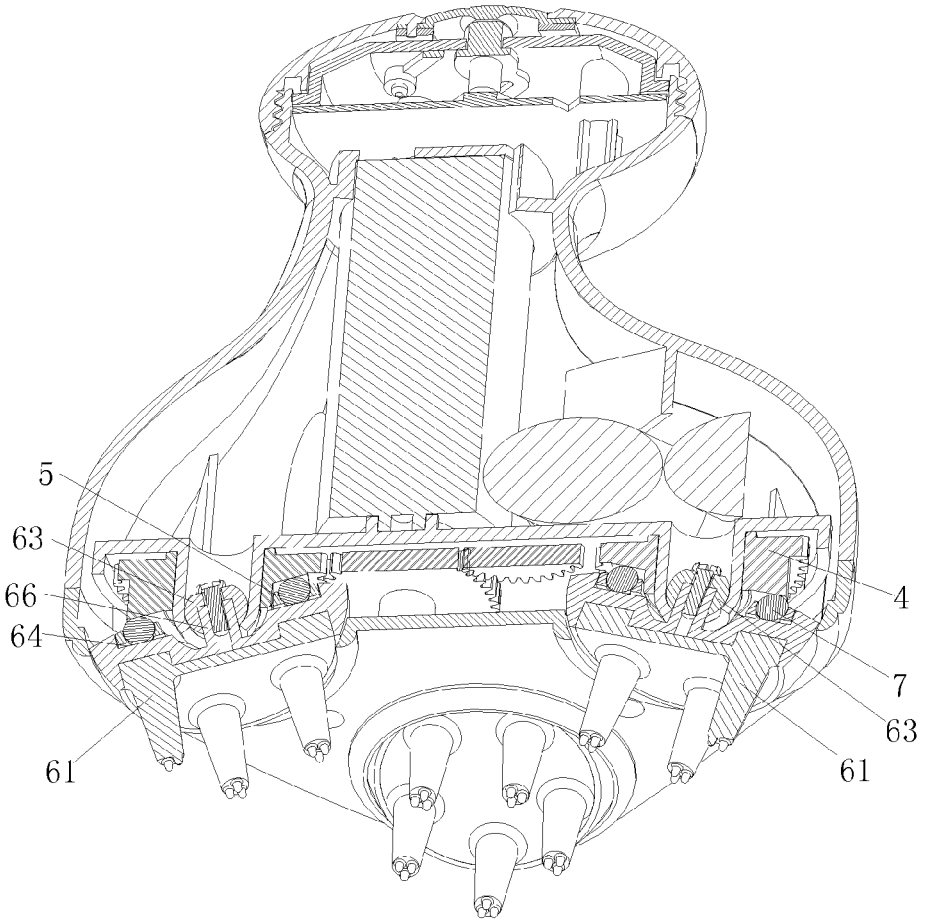
Figure 3:
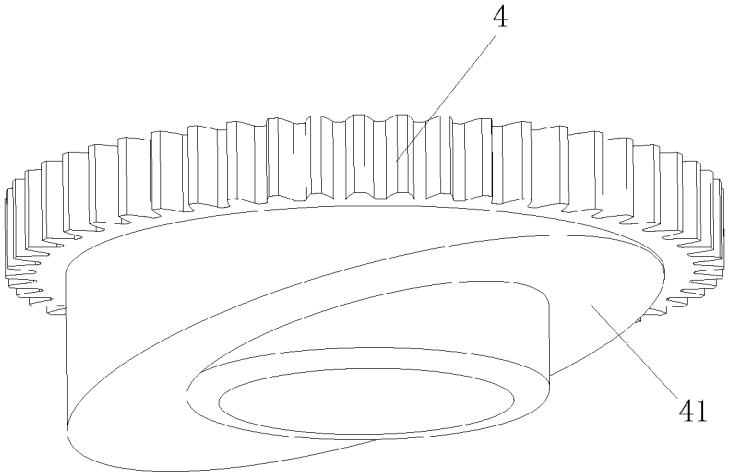
FIG. 3 is a schematic structure view of a driving wheel of the first embodiment of the present invention.

As shown in FIG. 1 to FIG. 3, the head massager shown in the figures is the first embodiment. The head massager includes a housing 1, a power source 2, a drive mechanism 3, at least one driving wheel 4, at least one push component and at least one massage head assembly 6 with soft massage heads 61. The massage head assembly 6 corresponds to the driving wheel 4 and the push component. The power source 2 is fixed in an inner side of the housing 1, the driving wheel 4 is driven to rotate around a first rotation axis A by the power source by means of the drive mechanism 3, the push component is tilted relative to the first rotation axis A, the push component corresponding to the driving wheel 4 is driven to rotate around the first rotation axis A by the driving wheel 4, the massage head assembly 6 and the housing 1 are connected by means of a spherical hinge, and the massage head assembly 6 corresponding to the driving wheel 4 is driven to rotate around a center of the spherical hinge by the driving wheel 4.

The housing 1 includes a main body 11, both of a top and a bottom of the main body 11 are an opening, the top opening is closed by a top cover 12, the bottom opening is provided with a base 13 used for mounting and supporting the power source, the driving wheel and the massage head assembly.

The base 13 is provided with spherical bowls 14 which correspond to the driving wheels respectively, a bottom of the spherical bowl 14 is a spherical surface, the driving wheel 4 is disposed around an outer circumference of the spherical bowl 14, the driving wheel 4 can rotate around the first rotation axis A relative to the spherical bowl 14, and the first rotation axis A can pass through a center of the spherical bowl (namely, the center of the spherical surface).

The driving wheel 4 is provided with a lower end face 41, the lower end face 41 is a slope which is tilted relative to the first rotation axis, that is, there is an angle unequal to 0° or 90° between the lower end face and the first rotation axis.

The massage head assembly 6 includes a fixing seat of a massage head 62, soft massage heads 61 and a spherical head 63, the fixing seat of the massage head 62 includes an upper end face 64 (namely, an upper end face of the whole massage head assembly) facing the driving wheel and a lower end face 65 opposite to the driving wheel, the upper end face 64 engages with the driving wheel 4, the soft massage heads 61 are fixed on the lower end face 65. A middle part of an upper end face of the fixing seat of the massage head is protruded upwards to form an extending post 66.

A bottom of the spherical bowl 14 on the base is provided with a through groove penetrating the spherical bowl up and down, the extending post 66 passes through the through groove upwards and arrives in an inner side of the spherical bowl 14, the spherical head and the extending post are fixed, therefore, the spherical head is restricted in the bottom of the spherical bowl 14 by means of the extending post 66, the spherical head 63 can rotate around the center of the spherical bowl in the spherical bowl 14 relative to X axis, Y axis and Z axis, but it can't move relative to the X axis, the Y axis or the Z axis. The X axis, Y axis and Z axis are perpendicular each another and meet in the center of the spherical bowl.

A plurality of balls 7 are provided between the lower end face 41 of the driving wheel 4 and the upper end face 64 of the fixing seat of the massage head, a bottom of each of the plurality of balls 7 is tangent to the upper end face 64, that is, both the lower end face 41 and the upper end face 64 are tangent surfaces of each ball. The upper end face of the massage head 64 can be in parallel with the lower end face of the driving wheel 41. All of the balls 7 are rotatably arranged on a ball fixing seat 5 which is fixed to the driving wheel 4.

The power source 2 can be a gear motor, and the drive mechanism 3 can be a gear set. The driving wheel 4 is driven to rotate around the first rotation axis A by the gear motor by means of the gear set, and the massage head assembly 6 is driven to rotate around the center of the spherical hinge by the lower end face of the driving wheel 41 by means of the balls 7.

Since the lower end face of the driving wheel 41 is a slope, the massage head assembly can rotate in the space formed by the X axis, Y axis and Z axis in order to simulate human hands to grasp and knead human head. Thus the massaging comfort degree is improved.

In this embodiment, the head massager further includes a button 8 and a control circuit board 9, if the button is pressed, the gear motor is started by the control circuit board to thereby grasp the human head.

In this embodiment, the lower end face of the driving wheel is the push component, a force is applied on the upper end face of the massage head assembly by the lower end face of the driving wheel by means of the balls, furthermore, the massage head assembly (soft massage heads) is driven to rotate around the center of the spherical hinge. The plurality of balls are provided between the driving wheel and the corresponding massage head assembly, each of the balls has an equal diameter, the upper end face of the massage head assembly can be a slope and in parallel with the lower end face of the driving wheel. It is should be understood that the diameter of each ball can be different, that is, the upper end face of the fixing seat of the massage head is a slope, however, this upper end face can be not parallel to the lower end face of the driving wheel.

In this embodiment, the push component is the lower end face of the driving wheel, the lower end face is a slope, and the slope rotates around the first rotation axis. Since the first rotation axis passes through the lower end face, therefore, the rotating trail of the lower end face forms two cones, and vertexes of the two cones are abutted against each other.

In this embodiment, each massage head assembly corresponds to one driving wheel and one push component, there can be one or more massage head assemblies, all of the massage head assemblies are driven by the same power source, for example, there can be three massage head assemblies which are distributed as a triangle. It should be understood that other number of the massage head assembly is allowable according to ergonomics.

In this embodiment, the drive mechanism can be a gear set, different driving wheels such as gears are driven to rotate by the power source by means of the gear set, each driving wheel rotates around the first rotation axis of the driving wheel itself, the drive mechanism can be a linkage, a chain transmission mechanism or other mechanism able to drive the driving wheel to rotate.

In this embodiment, the massage head assembly and the housing are connected by means of the spherical hinge, for example, the massage head assembly includes a spherical head, the whole surface of the spherical head can be a spherical surface, or part of the surface of the spherical head can be a spherical surface, the housing includes a spherical bowl correspondingly, the whole surface of the spherical bowl can be a spherical surface, or part of the surface of the spherical bowl can be a spherical surface, and an engaging surface of the spherical head and the spherical bowl is a spherical surface. It should be understood that the massage head assembly also can include a spherical bowl, and the housing can include a spherical head correspondingly.

Figure 4:
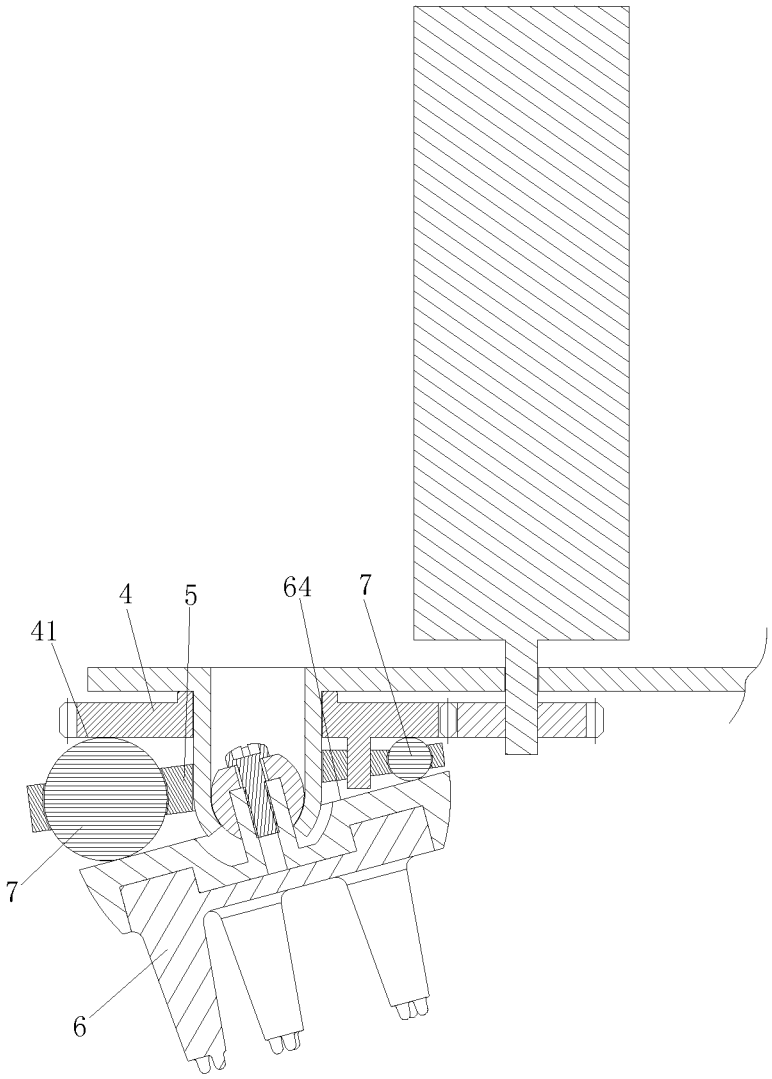
FIG. 4 is a schematic structure view of a head massager of a second embodiment of the present invention.

As shown in FIG. 4, the head massager shown in the figures is the second embodiment. The difference between the first and second embodiments is that the lower end face 41 of the driving wheel 4 is a horizontal surface and diameters of the balls 7 are different from each other.

In this embodiment, the lower end face of the driving wheel 41 is a horizontal surface, namely, the lower end face is perpendicular to the first rotation axis, the diameters of the balls 7 are different from each other, tops of all the balls are tangent to the lower end face of the driving wheel 41, bottoms of all the balls are tangent to the upper end face 64 of the massage head assembly 6, that is, both of the lower end face 41 and the upper end face 64 are common tangent planes of all the balls. The bottoms of all the balls share one tangent plane which is a slope, that is, an upper surface 64 of the fixing seat of the massage head is a slope. The angle between the slope and the first rotation axis of the driving wheel is not 0° or 90°.

All of the balls are rotatably arranged on the ball fixing seat 5, and the ball fixing seat is fixed on the driving wheel 4.

Figure 5:
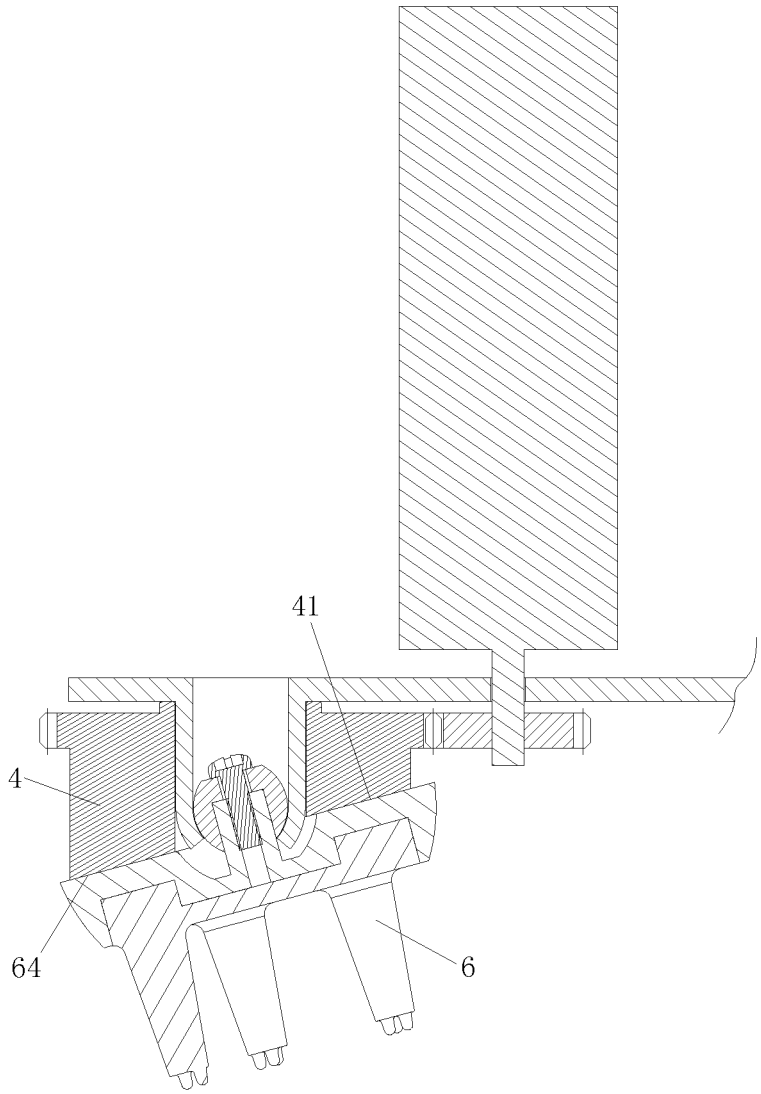
FIG. 5 is a schematic structure view of a head massager of a third embodiment of the present invention.

As shown in FIG. 5, the head massager shown in the figures is the third embodiment. Comparing with the first and second embodiments, the third embodiment has the following main features: the lower end face 41 of the driving wheel 4 is a slope, the upper end face 64 of the massage head assembly 6 is a slope, the lower end face 41 contacts with the upper end face 64, that is, the massage head assembly 6 is directly driven to rotate around the center of the spherical hinge by the lower end face 41 of the driving wheel 4.

Figure 6:
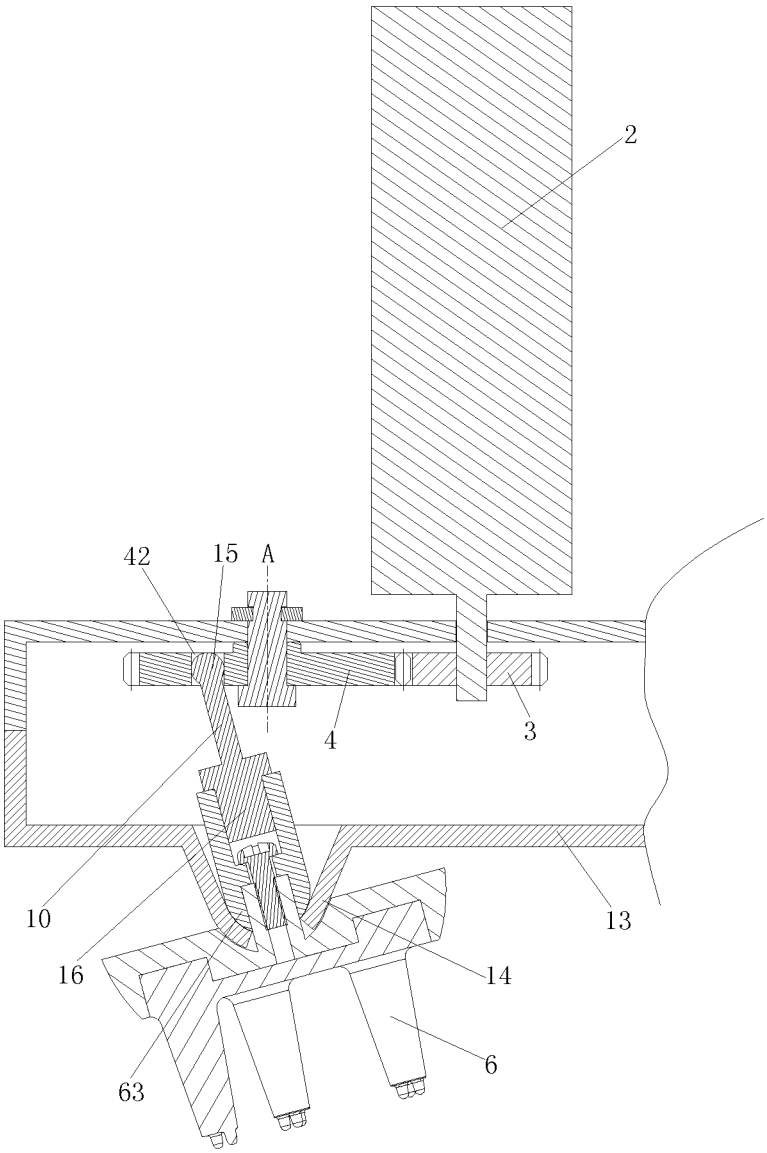
FIG. 6 is a schematic structure view of a head massager of a fourth embodiment of the present invention.

As shown in FIG. 6, the head massager shown in the figures is the fourth embodiment. The head massager includes a housing, a power source 2, a drive mechanism 3, at least one driving wheel 4, at least one push component 10 and at least one massage head assembly 6 with soft massage heads 61. The massage head assembly corresponds to the driving wheel and the push component. The power source is fixed in an inner side of the housing, the driving wheel is driven to rotate around a first rotation axis by the power source by means of the drive mechanism, the push component is tilted relative to the first rotation axis, the push component corresponding to the driving wheel is driven to rotate around the first rotation axis A by the driving wheel, the massage head assembly and the housing are connected by means of a spherical hinge, and the massage head assembly corresponding to the driving wheel is driven to rotate around a center of the spherical hinge by the driving wheel.

A bottom opening of the housing is provided with a base 13, the driving wheel 4 is mounted on the base 13, the driving wheel can be driven to rotate around the first rotation axis by the power source, the base is provided with a spherical bowl 14 located below the driving wheel 4.

The massage head assembly 6 includes a spherical head 63 corresponding to the spherical bowl, the spherical head 63 engages with the spherical bowl 14 so as to form a spherical hinge connection, the spherical head is restricted in the bottom of the spherical bowl by a extending post 66, and the spherical head can rotate around the center of the spherical head relative to X axis, Y axis and Z axis.

The driving wheel 4 defines an eccentric hole 42 penetrating the driving wheel from up and down, the eccentric hole 42 and the first rotation axis are eccentrically arranged, and the center of the spherical head is located outside the axis of the eccentric hole.

A push component 10 is tilted relative to the first rotation axis, the push component includes a force bearing end 15 located at the top and a force applying end 16 located at the bottom, the force bearing end 15 is engaged in the eccentric hole 42 of the driving wheel, and the force applying end 16 and the spherical head 63 are fixed.

The driving wheel 4 is driven to rotate around the first rotation axis by the power source 2, the push component 10 is driven to rotate around the first rotation axis by the driving wheel 4, and the massage head assembly 6 is further driven to rotate around the center of the spherical head.

In this embodiment, since the center of the spherical head deviates from the center of the axis of the eccentric hole, the push component is arranged aslant, and the rotating trail of the push component can form a cone.

The present invention has been further detailed in the above descriptions with reference to the preferred embodiments; however, it shall not be construed that implementations of the present invention are only limited to these descriptions. Many simple deductions or replacements may further be made by those of ordinary skill in the art without departing from the conception of the present invention, and all of the deductions or replacements shall be considered to be covered within the protection scope of the present invention.

The invention claimed is:

1. A head massager, comprising a housing, a power source, at least one driving wheel and at least one massage head assembly with soft massage heads, wherein the power source is fixed in an inner side of the housing; wherein each at least one driving wheel corresponds to a respective one massage head assembly of the at least one massage head assembly said each at least one driving wheel is driven to rotate around a first rotation axis by the power source, each of the at least one massage head assembly is located below the corresponding driving wheel, wherein the head massager further comprises at least one push component which corresponds to a respective one of the at least one massage head assembly, the at least one push component is tilted relative to the first rotation axis, the at least one massage head assembly and the at least one housing are connected by a spherical hinge, the at least one push component is driven to rotate around the first rotation axis by the corresponding driving wheel, the at least one massage head assembly is driven to rotate around a center of the spherical hinge by the at least one push component;

wherein each of the at least one driving wheel comprises a lower end face which is faced to the at least one massage head assembly, each of the at least one massage head assembly comprises an upper end face facing the at least one driving wheel, a plurality of balls are provided between the upper end face and the lower end face, diameters of all the balls are different from each other, the balls are the at least one push component, the upper end face is a slope tilted relative to the first rotation axis.

2. The head massager of claim 1, wherein the at least one push component is a slope tilted relative to the first rotation axis, each of the at least one driving wheel comprises a lower end face facing the massage head assembly, each of the at least one massage head assembly comprises an upper end face facing the driving wheel, the upper end face is a slope tilted relative to the first rotation axis, the at least one push component is the lower end face, the lower end face applies force to the upper end face so as to drive the at least one massage head assembly to rotate around the center of the spherical hinge.

3. The head massager of claim 2, wherein the upper end face is contacted with the lower end face.

4. The head massager of claim 2, wherein the balls are arranged on a ball fixing seat, the ball fixing seat is fixed to the at least one driving wheel.

5. The head massager of claim 1, wherein the center of the spherical hinge is located outside the axis of the eccentric hole.

6. The head massager of claim 1, wherein each of the at least one massage head assembly comprises a spherical head, the housing comprises a spherical bowl, the spherical head engages with the spherical bowl, so that the at least one massage head assembly and the housing are connected by means of the spherical hinge, the spherical head is restricted in a bottom of the spherical bowl by a fixing component.

7. The head massager of claim 6, wherein the bottom of the spherical bowl is provided with a through groove penetrating the spherical bowl up and down, each of the at least one massage head assembly comprises an extending post protruded upwards, the extending post passes through the through groove and arrives in an inner side of the spherical bowl, the extending post is fixed to the spherical head, the extending post is the fixing component.

* * * * *